US005987673A

United States Patent [19]

Smith

[11] Patent Number: 5,987,673

[45] Date of Patent: Nov. 23, 1999

[54] UNDERCARRIAGE EXTENSION

[75] Inventor: Glenn S Smith, Brisbane, Australia

[73] Assignee: Ferno-Washington, Inc., Wilmington, Ohio

[21] Appl. No.: 09/051,864

[22] PCT Filed: Nov. 7, 1996

[86] PCT No.: PCT/AU96/00702

§ 371 Date: Apr. 21, 1998

§ 102(e) Date: Apr. 21, 1998

[87] PCT Pub. No.: WO97/17047

PCT Pub. Date: May 15, 1997

[30] Foreign Application Priority Data

Nov. 7, 1995 [AU] Australia ..... PN6390

[51] Int. Cl.[6] ..... A47B 1/00

[52] U.S. Cl. ..... 5/627; 5/11; 5/611; 5/86.1; 16/115; 280/655; 280/655.1; 296/20

[58] Field of Search ..... 5/11, 611, 86.1, 5/627; 74/527; 296/20; 16/115; 280/655, 655.1

[56] References Cited

U.S. PATENT DOCUMENTS

| | | | |
|---|---|---|---|
| 2,877,048 | 3/1959 | Weil | 296/20 |
| 3,088,770 | 5/1963 | Weil et al. . | |
| 3,493,262 | 2/1970 | Ferneau | 296/20 |
| 3,637,232 | 1/1972 | Bourgraf et al. . | |
| 4,064,574 | 12/1977 | Schnitzler . | |
| 4,263,818 | 4/1981 | Ozaki | 74/527 X |
| 4,726,252 | 2/1988 | Dawson | 74/527 X |
| 5,099,539 | 3/1992 | Forester | 16/115 X |
| 5,271,113 | 12/1993 | White | 5/11 X |
| 5,365,622 | 11/1994 | Schirmer | 5/611 |
| 5,385,070 | 1/1995 | Tseng | 74/527 X |
| 5,432,966 | 7/1995 | Berta et al. | 5/11 X |
| 5,509,159 | 4/1996 | Du-Bois . | |
| 5,575,026 | 11/1996 | Way et al. | 5/611 X |
| 5,740,884 | 4/1998 | DiMucci et al. | 5/611 X |

FOREIGN PATENT DOCUMENTS

| | | |
|---|---|---|
| 53000/94 | 1/1994 | Australia . |
| 8-26117 | 1/1996 | Japan . |
| 2241995 | 9/1991 | United Kingdom . |
| 2280706 | 2/1995 | United Kingdom . |
| 95/20933 | 8/1995 | WIPO . |

*Primary Examiner*—Terry Lee Melius
*Assistant Examiner*—Rodrigo J. Morales
*Attorney, Agent, or Firm*—Killworth, Gottman, Hagan & Schaeff, LLP

[57] ABSTRACT

An extendable hand control for a stretcher undercarriage (10) which has height adjustable legs (11, 12). It comprises a handle (19) fitted to an end of a tube (20), slidable within an undercarriage frame member (21). The handle has an associated lever (15) which operates a control cable (14) for adjusting the height of the height adjustable legs (11, 12) . The arrangement includes a locking bar (26) within the slidable tube (20) which sets the maximum extendable position of the handle and the fully retractable position of the handle.

8 Claims, 7 Drawing Sheets

UNDERCARRIAGE EXTENSION

BACKGROUND OF THE INVENTION

This invention relates to stretcher undercarriages and is particularly concerned with multi-height adjustable undercarriages which are operable by hand controls such as brake levers, on one or both ends of the undercarriage.

Such height adjustable undercarriages are typically used for loading patients into ambulances where it is necessary to firstly collapse the leading set of undercarriage legs during loading, followed by collapsing the trailing set of legs. The reverse process occurs when the undercarriage is being removed from the ambulance.

An example of a typical height adjustable undercarriage is the subject of U.S. Pat. No. 5,509,159 dated Apr. 23, 1996, assigned to Ferno Washington, Inc.

A common failing with height adjustable undercarriages is that when a taller than average person is being conveyed into or from an ambulance, the feet of that person tend to extend out past the hand controls on the end of the undercarriage making it difficult for the attendant to move the undercarriage with ease, let alone be able to readily manipulate the height adjusting hand controls. This failing can be overcome when height adjusting hand controls are not required, by using extendable handles which slide within the upper longitudinally extending support framework of the undercarriage, and which extend the effective length of the undercarriage. However when hand controls are present on the end of the undercarriage, their very design and nature means that they must be located in a fixed position to be operable and such extendable handles cannot be used. This problem has been addressed and it has now been found after much trial and experimentation that extendable hand grips with their controls for multi-height adjustable undercarriages, can be produced.

OBJECT OF THE INVENTION

It is therefore an object of the invention to provide combination hand grips with controls for adjusting the height of stretcher undercarriages, which are longitudinally movable and operable.

SUMMARY OF THE INVENTION

According to the present invention there is provided an extendable hand grip control arrangement for a stretcher undercarriage which has height adjustable legs, said arrangement comprising a handle fitted to an end of a tube slidable within an uppermost longitudinally extending undercarriage frame member, said handle having an associated manipulable lever which operates a control mechanism for adjusting the height of the height adjustable legs, the arrangement including a locking bar within the slidable tube which sets the maximum extendable position of the handle and the fully retractable position of the handle.

The control mechanism includes a rod pivotally connected thereto, which rod extends substantially parallel to the slidable tube and through a housing located on the end of the undercarriage frame member, said housing being restrictively moveable in parallel with the undercarriage frame member along a short track fixed to the end region of the undercarriage frame member, said housing having a spring-biased cable fitted thereto which activates the height adjustable legs.

The housing includes a pivoting arm which is adapted to lock into the control rod when the slidable tube is fully retracted and to also set the maximum extendable length of the slidable tube out of the undercarriage frame member.

The locking bar has a projection on one end which extends through an opening in the slidable tube and locates within one of two holes formed in the undercarriage frame member to thereby set the said maximum extendable position of the handle and the fully retractable position of the handle; the other end of the locking bar having a manipulable button which locates in the region of the handle and enables the projection to be released from one or other of the holes in the undercarriage frame member.

Such an arrangement operates as follows. When the slidable tube is fully retracted into the longitudinally extending undercarriage frame member, that is when the handle is not extended, the pivoting arm engages the control rod to prevent relative movement thereof. The locking bar is spring-biased to maintain the slidable tube and the undercarriage frame member in rigid union by virtue of the associated projection extending through the walls of these members. Manipulation of the lever fitted to the handle pulls the control rod and housing, in which the pivoting arm is located, towards the handle, causing the attached cable to collapse the legs of the undercarriage in a known manner.

To extend the slidable tube to its fully extendable position, the button fitted to the end of the locking bar is depressed so that the other end of the locking bar pivots the associated projection from the aligned opening in the slidable tube and the hole in the undercarriage frame member, thereby enabling the slidable tube to be pulled outwardly with respect to the frame member until further movement is resisted by, for instance, a pin or like means in the end of the control rod which prevents the control rod moving any further through the associated housing. At this position, the projection on the locking bar is brought into alignment with the second hole in the undercarriage frame member and seats in that hole to provide a firmly fixed position for the handle. Manipulation of the lever, as before, pulls on the control rod and the housing is moved along its track towards the handle. The cable attached to the housing is once more extended and the legs of the undercarriage are collapsed as before.

The handle can be a molded rubber or plastic grip, or the like, fitted over the end of the slidable tube, or can be a custom made handpiece which is connected to the tube by known means.

The lever which is associated with the handle is suitably pivoted to a casing formed on the slidable tube, inwardly of the handle. A preferred lever design would be one similar to a bicycle brake handle lever.

The slidable tube will be configured to fit within the cavity formed in the longitudinally extending undercarriage frame member. The undercarriage frame member may have a hollow rectangular configuration which may have strengthening ribs formed therein. The slidable tube will therefore have a smaller rectangular configuration to enable it to readily slide within the frame member but be closely supported by all wall members so that it maintains a parallel alignment with the frame member when it is being withdrawn therefrom.

The locking bar which is located in the slidable tube, ideally extends from one end of that tube to the other. It may be of any configuration, such as circular in cross-section, and is suitably pivoted between opposing walls of the slidable tube on a pin located mid-way along the tube. The locking bar can be spring biased so that the terminal projection is normally urged through the opening in the slidable tube and the button projects upwardly by a maximum extent at the handle end of the tube. Spring biasing of the locking bar can be achieved by known means such as by the use of a leaf or like spring fitted in one end section of the tube.

The projection formed on the terminal end of the locking bar must be of such a construction as to transmit all applied forces through the handles to the undercarriage. The construction must thus be rigid and strong.

The control rod is suitably a longitudinally extending metal billet on the underside of the hand control arrangement which is pivotally connected to the lever in such a manner that it maintains a substantially parallel location with respect to the slidable tube whether the lever is depressed or not. An opening may be formed through the control rod close to the pivotal connection to enable the pivoting arm, contained within the housing located on the end of the undercarriage frame member, to extend in to the opening and thereby lock the arm and hence the housing to the control rod. The pin in the terminal end of control rod can be a small tube or rod extending at right angles through the tip region of the control rod.

The housing is preferably in the form of a rectangular block having opposing slots through which the control rod projects. Another slot is formed in the entry wall of the housing to enable the arm located therein to be pivoted against the control rod when a locking pin is projected therein. This locking pin can be a finger element connected to the handle end of the slidable tube which is forced into the housing and against the arm when the slidable tube is fully retracted into the undercarriage frame member. Upon withdrawal of the finger element from the housing, the arm is forced away from the control rod by means of a coil spring acting between the arm and an internal wall of the housing. Suitably, the arm has a tongue which is designed to project into the aforementioned opening in the control rod as a means of retaining the control rod in a fixed relationship with respect to the housing.

The track upon which the housing can move can be a profiled metal section which captures the base of the housing therein. Movement of the housing is restricted to a distance which corresponds with the maximum length of extension of the associated cable which controls the collapsing of the undercarriage legs in a known manner. This distance is generally of the order of a few centimeters.

The cable attached to the housing is spring biased in a covering which biases the housing in a direction away from the handle, that is, towards one end of the track.

The arrangement thus described enables the handles and undercarriage controls to be relocated away from the end of the undercarriage frame while maintaining complete control over the movement and collapse of the undercarriage during loading and unloading from a vehicle.

DESCRIPTION OF PREFERRED EMBODIMENT

Figure 1:
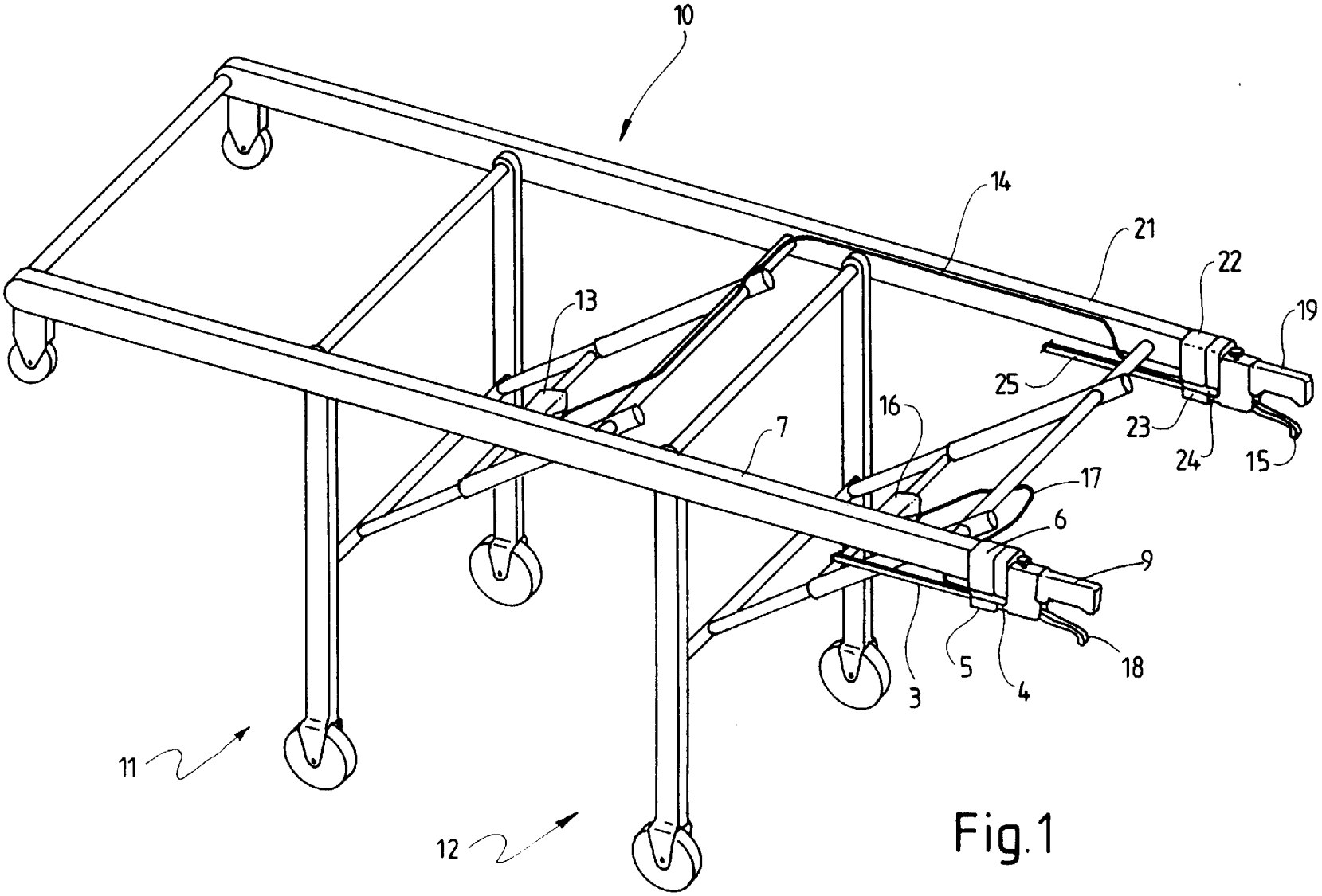
FIG. 1 is a perspective view from above of a stretcher undercarriage with a relocatable hand grip/control arrangement according to the present invention showing the arrangement in the normal operating position.

A preferred embodiment of the invention will now be described with reference to the drawings. In all of these drawings, like reference numerals refer to like parts.

Figure 2:
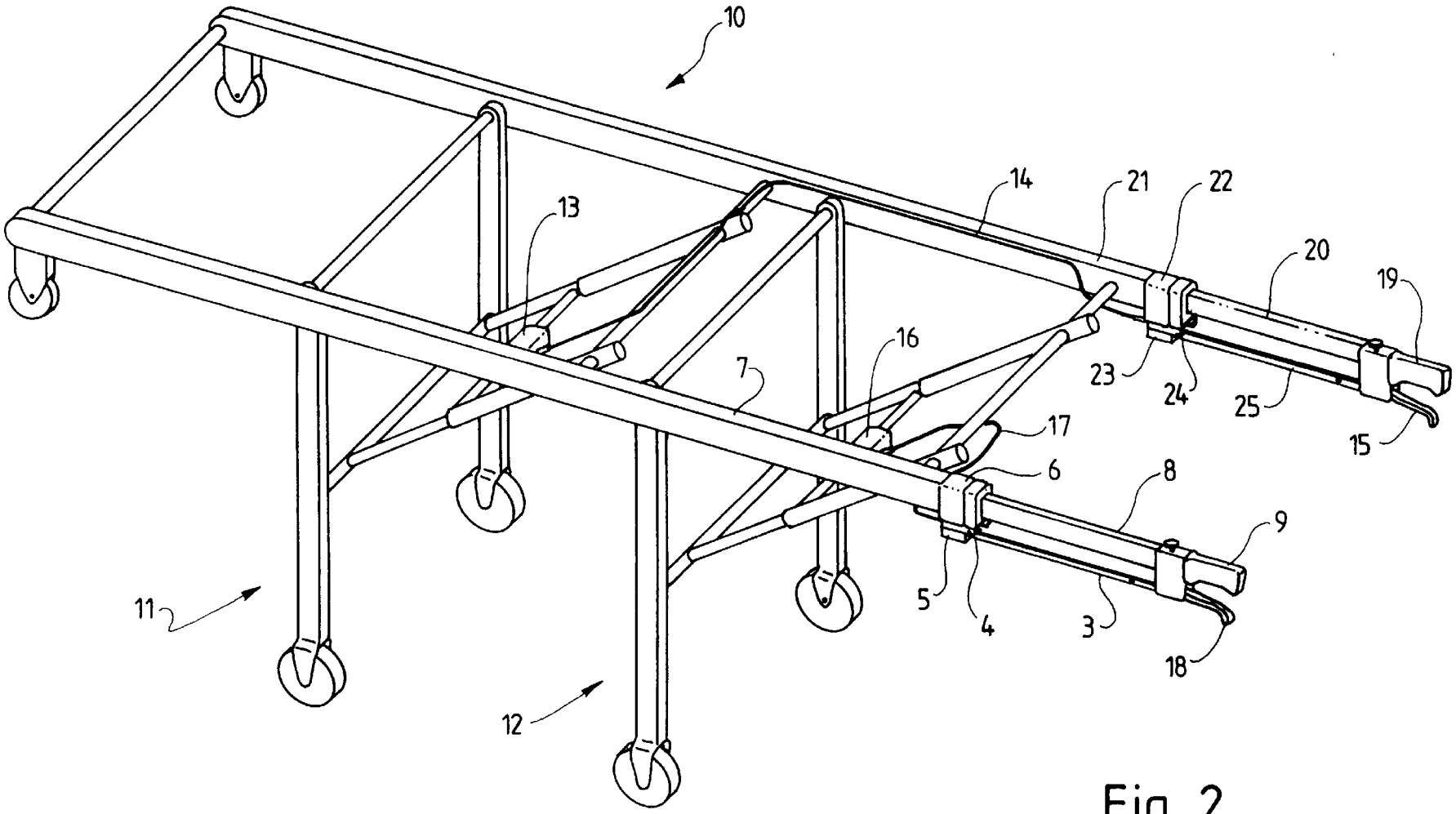
FIG. 2 is a perspective view from above of the stretcher undercarriage of FIG. 1 with the hand grip/control arrangement in an extended operating position.

Referring firstly to FIGS. 1 and 2, these depict a typical stretcher undercarriage 10, having a pair of wheeled forward legs 11 and a pair of wheeled trailing legs 12. The forward legs 11 are collapsible through the agency of mechanism 13 which is activated by operating cable 14 when lever 15 is squeezed by hand. Similarly, trailing legs 12 are collapsible through the agency of mechanism 16 which is activated by operating cable 17 when lever 18 is squeezed.

The relocatable hand grip/control arrangements (for there are two) each comprises a handle 19, 9 fitted to the end of a hollow rectangular section aluminium tube 20, 8. Each tube 20, 8 is slidable within a hollow upper frame member 21, 7 of the undercarriage in a parallel longitudinal direction. A collar 22, 6 is fitted to the end of each frame member 21, 7 and a housing 23, 5 is located on the bottom of each collar. Each housing is connected to a respective operating cable 14, 17 and is slidable within a track 24, 4. The movement of each housing along its respective track is effected by control rods 25, 3 to be described hereinafter.

Figures 3, 4:
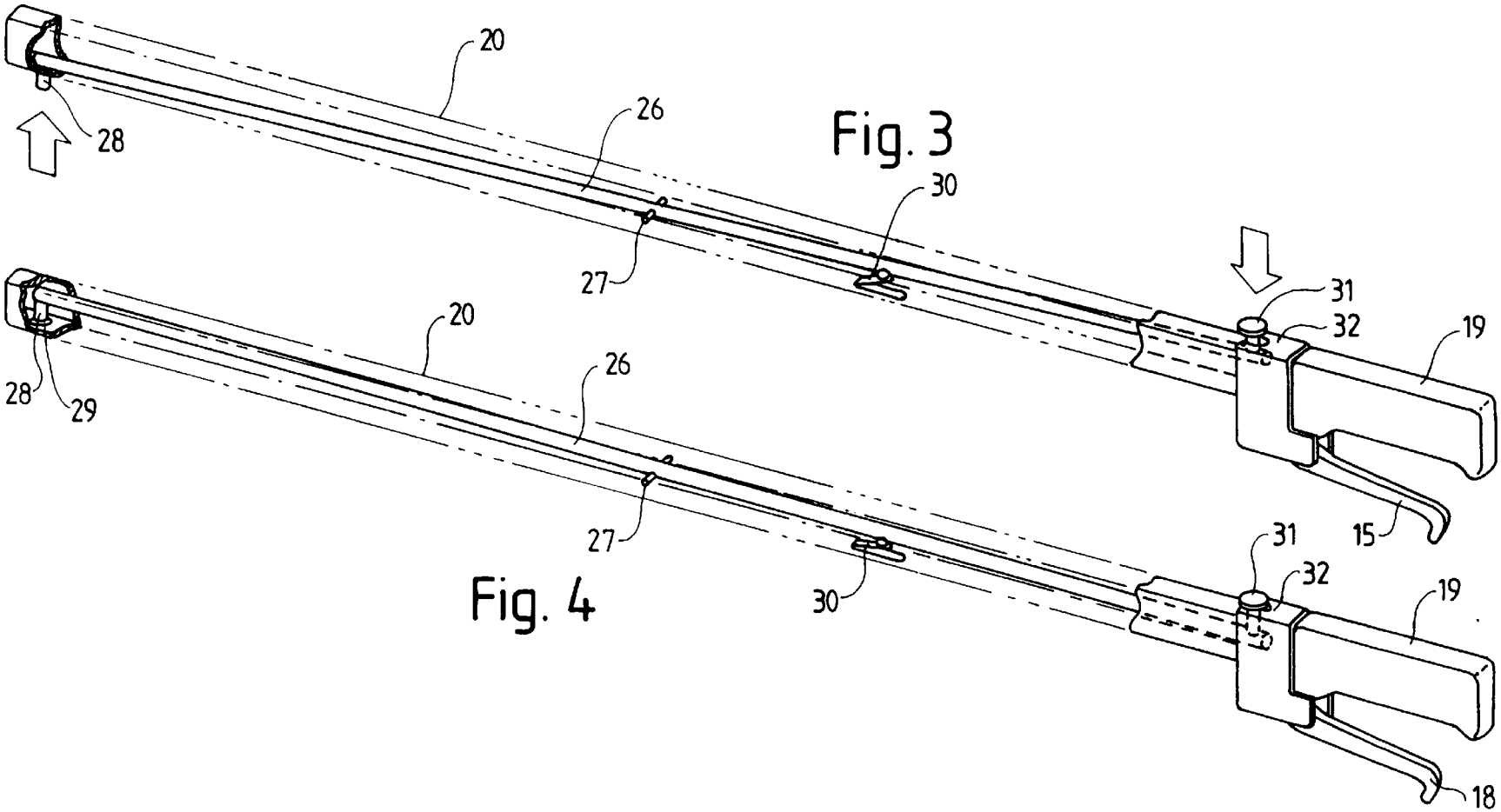
FIG. 3 is an enlarged perspective view of the slidable tube component, shown in FIGS. 1 and 2, in one mode of operation.
FIG. 4 is an enlarged perspective view of the slidable tube component of FIG. 3 in another mode of operation.
Figure 5:
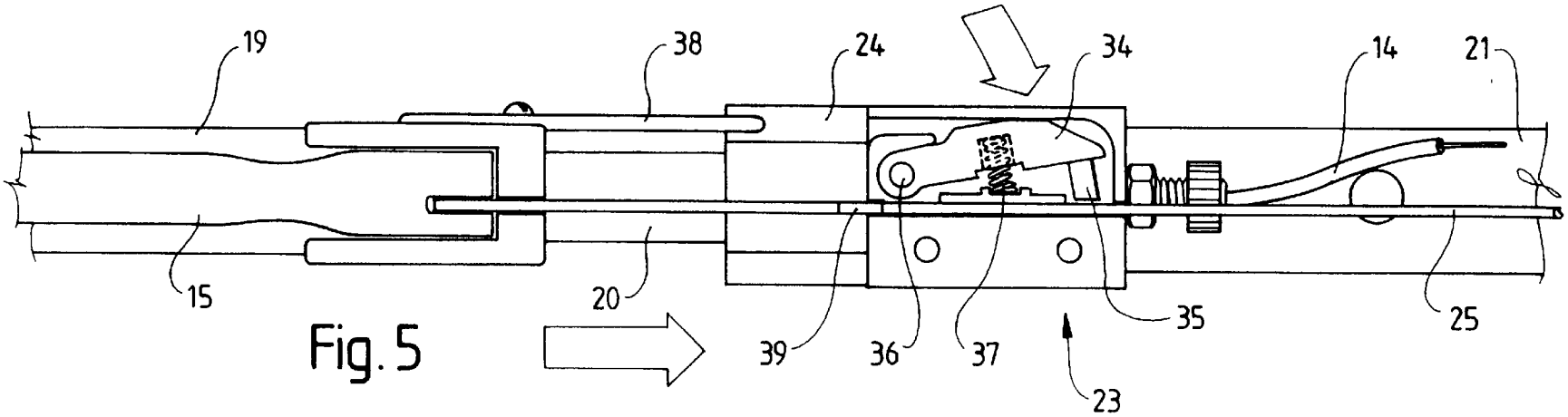
FIG. 5 is a partial top plan view of the arrangement depicted in the previous drawings showing the housing, with cap removed, with internal pivoting arm in one mode of operation.

Reference is now made to FIGS. 3 and 4 which show an enlarged view of the slidable tube 20 (tube 8 has a similar construction and operation) and, in particular, the internal locking bar 26. The locking bar 26 extends substantially from one end of the tube to the other and is pivoted about a pin 27 extending through the side walls of the tube. One end of the locking bar has a projection 28 which is normally adapted to extend through an opening 29 in the tube and through one of two corresponding openings in the frame member 21, depending upon whether the tube is fully retracted or fully extended from the frame member. This normal configuration is depicted in FIG. 3 and is maintained by virtue of a leaf spring 30 fitted to the locking bar which biases the projection 28 through the opening and simultaneously biases the other end of the locking bar against a button 31 so that the button is projected upwardly by a maximum amount from its housing 32. Depressing the button by hand overcomes the resiliency in the spring and enables the locking bar to pivot and the projection to be disengaged from the stretcher frame and the slidable tube, as shown in FIG. 4.

Turning now to FIGS. 5 to 10, the mechanism by which the control rod 25 operates, will be explained (once again, it will be appreciated that control rod 3 operates in an analogous manner). The control rod 25 is pivotally connected to lever 15 and has an extension regulating pin 33 on its other end (see FIGS. 9 and 10). The control rod 25 extends through housing 23 in which is located a pivoting arm 34 having a tongue 35 on one end, a pivot pin 36 on the other end, and an intermediate spring 37 which tends to bias the tongue 35 away from the control rod 25.

Figure 6:
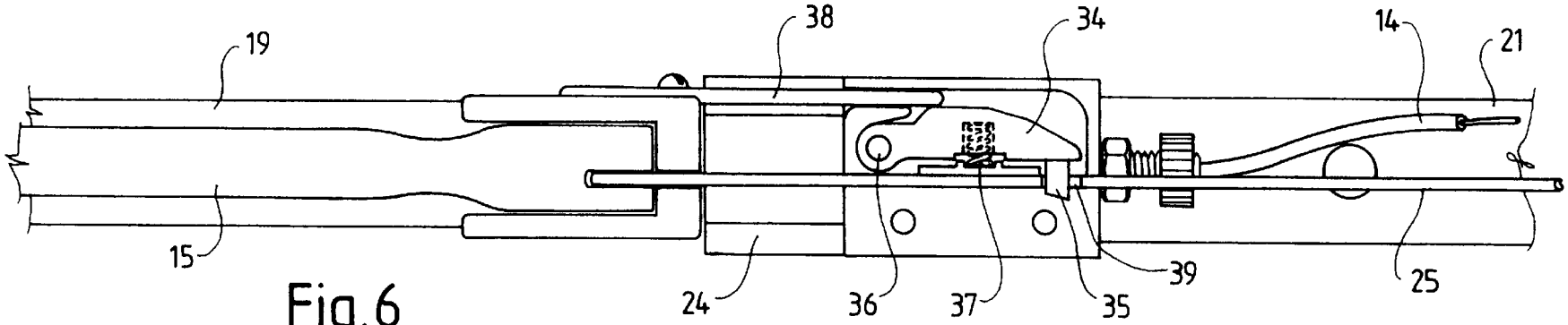
FIG. 6 is a similar view to FIG. 5 with the pivoting arm in another mode of operation.
Figure 7:
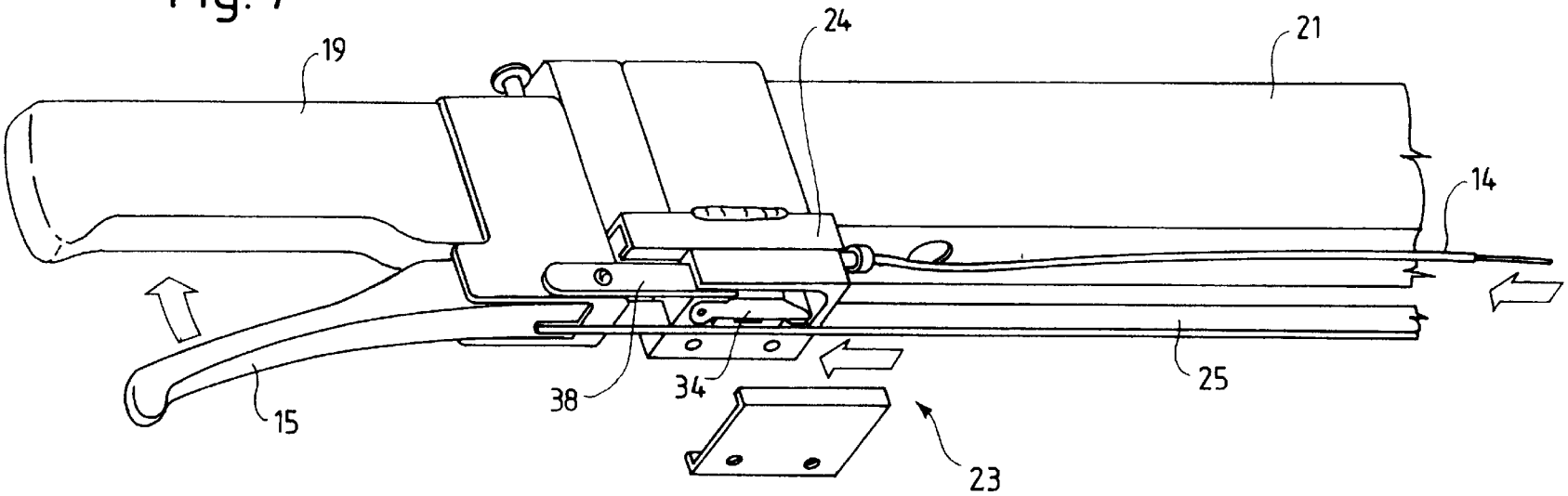
FIG. 7 is an enlarged perspective view from below showing the arrangement of FIG. 1 in one mode of operation.
Figure 8:
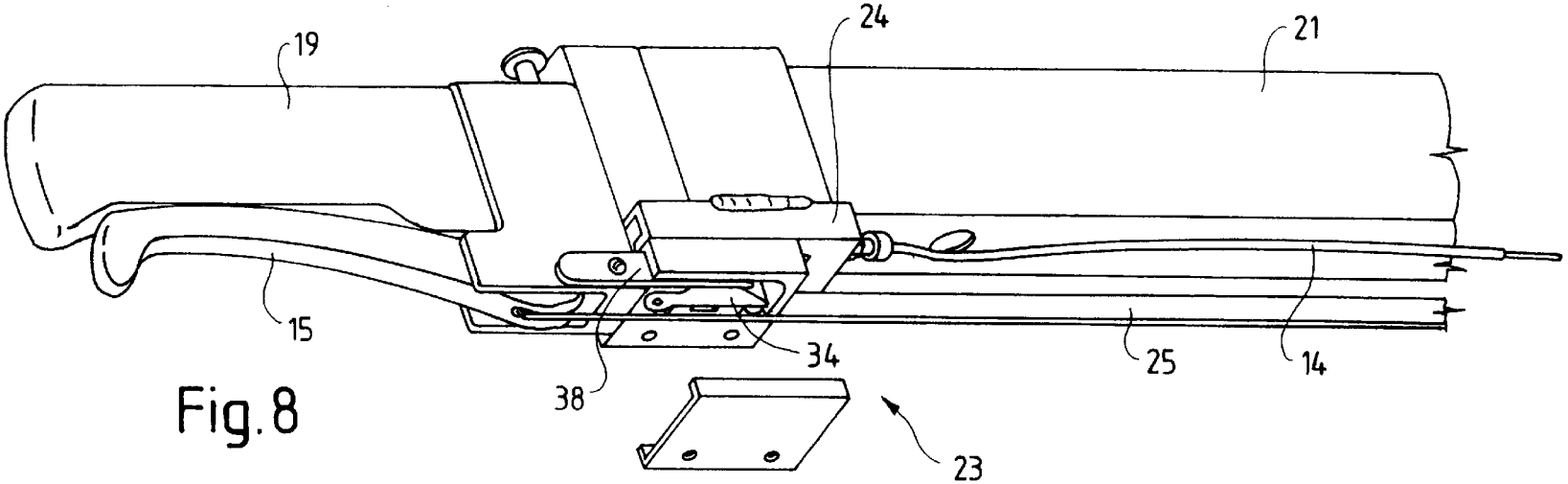
FIG. 8 is a similar view to FIG. 7 showing the arrangement in another mode of operation.

A finger element 38 fitted to a collar on the handle is arranged to project into the housing 23 when the slidable tube is retracted into the undercarriage frame member, as shown in FIG. 6. Such retraction causes the arm 34 to pivot from the location shown in FIG. 5 to the location shown in FIG. 6. This action is possible by reason of an opening 39 in the control rod 25 which enables the tongue 35 to project therein. This in effect locks the arm 34 and, more importantly, the housing 23 to the control rod 25. Such a configuration enables the undercarriage cable 14 to now be in an operable condition. The operation is depicted in FIGS. 7 and 8. When the lever 15 is depressed in the direction shown by the arrow in FIG. 7, the housing with attached cable 14 is moved towards the handle 19 along track 24, such movement also being illustrated with an arrow. This causes the cable to extend and collapse the undercarriage legs.

Figure 9:
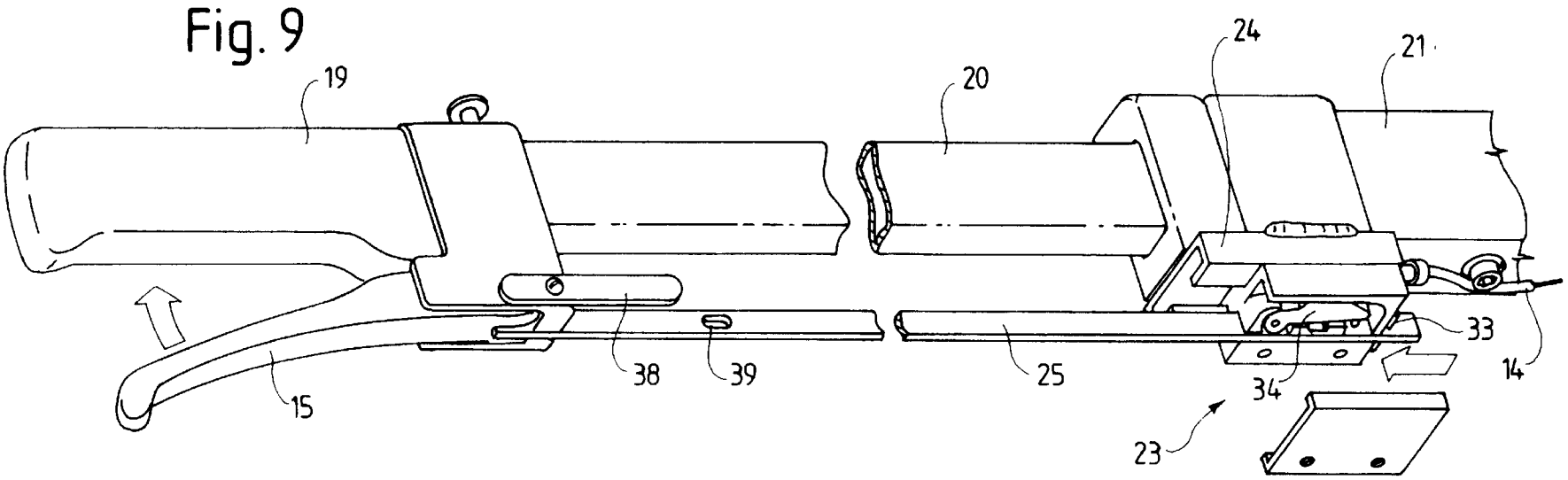
FIG. 9 is an enlarged perspective view from below showing the arrangement of FIG. 2 in one mode of operation.
Figure 10:
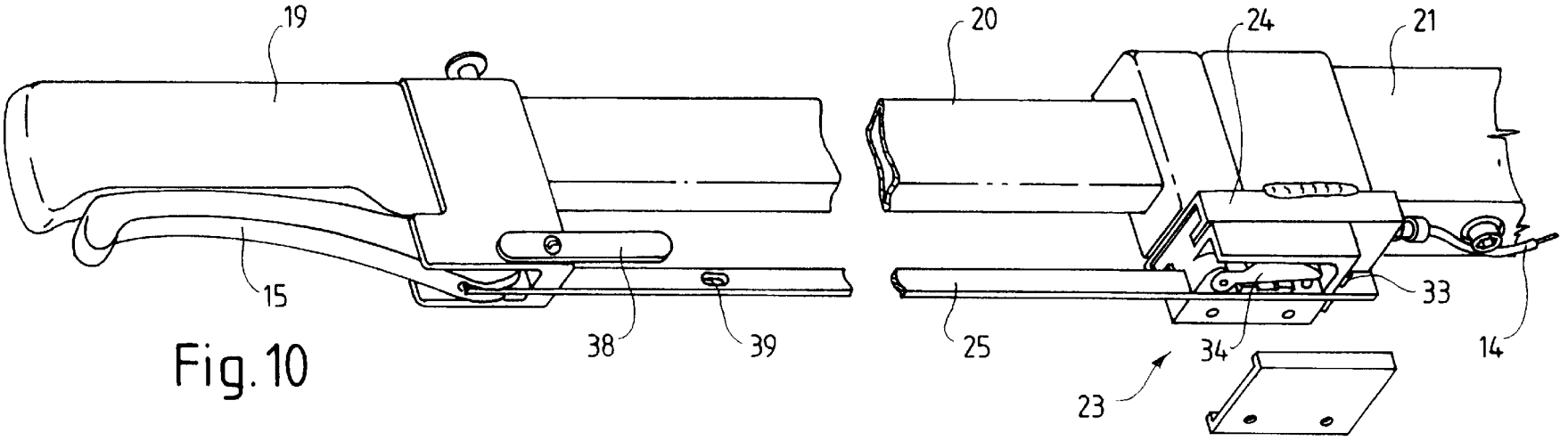
FIG. 10 is a similar view to FIG. 9 showing the arrangement in another mode of operation.

When the tube and handle are in the fully extended position as shown in FIGS. 9 and 10, the following set of parameters is in place. The sliding tube 20 is retained by the locking bar 26 locking into the tube and the undercarriage frame member. The control rod 25 is locked against the housing by the regulating pin 33. Depression of the lever 15 in the direction of the arrow thus moves the control rod 25 towards the handle and the associated housing 23 is pulled along track 24 to the position shown in FIG. 10. The cable 14 attached to the housing 23 is thereby extended and the undercarriage legs are collapsed. Release of the lever 15 causes the housing to move backwards along its track to the position shown in FIG. 9 by virtue of the spring biasing of the attached cable tending to pull it in this direction.

Figure 11:
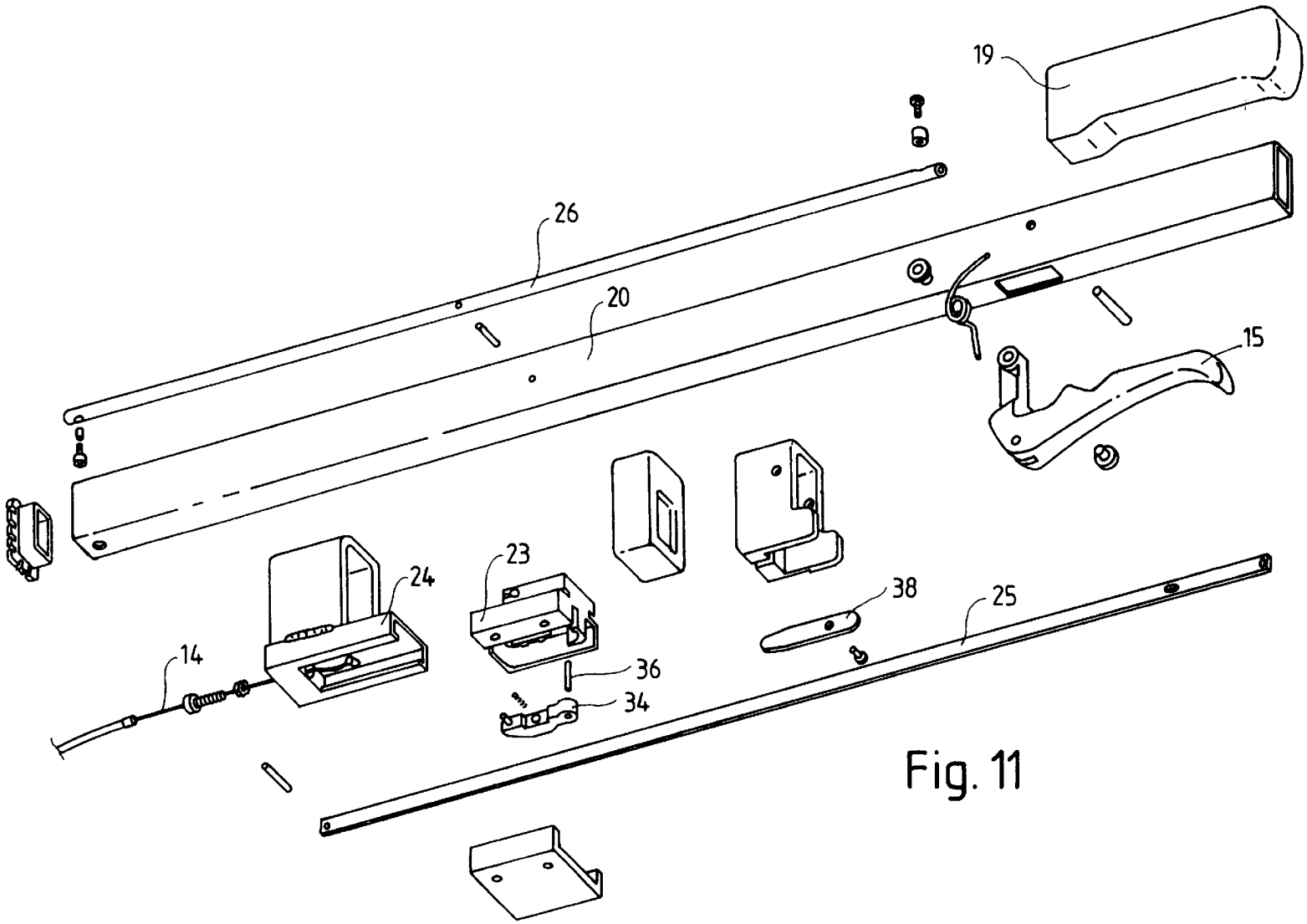
FIG. 11 is an exploded view of the componentry of the relocatable hand grip/control arrangement depicted in the preceding drawings.

FIG. 11 depicts all the components to assist the understanding of the previously described drawings.

Whilst the above has been given by way of illustrative example of the invention, many modifications and variation may be made thereto by persons skilled in the art without departing from the broad scope and ambit of the invention as herein set forth.

I claim:

1. An extendable hand grip control arrangement for a stretcher undercarriage, said stretcher undercarriage having a longitudinally-extending frame member and one or more height-adjustable legs connected to said frame member, said frame member having a track at a first end thereof, a first hole near said first end thereof and a second hole near a second end thereof, said arrangement comprising:

a tube slidable within said frame member;

a locking bar positioned within said tube, said locking bar limiting movement of said tube within said frame member between a maximum extendable position of said tube relative to said frame member and a fully retractable position of said tube relative to said frame member;

a handle fitted to a first end of said tube, said handle having a manipulable lever connected thereto;

a control rod pivotally connected to said handle and extending substantially parallel to said tube;

a housing slidably mounted to said track of said frame member, said housing having a pivoting arm which is adapted to lock into said control rod when said tube is in said fully retracted position; and, a spring-biased cable connecting said housing to said height-adjustable legs, wherein moving said housing activates said height-adjustable legs.

2. The extendable hand grip control arrangement of claim 1, said locking bar including:

a projection at one end of said locking bar extending through an opening in said tube, said projection being receivable by said first hole of said frame member when said tube is in said fully retractable position, said projection being receivable by said second hole of said frame member when said tube is in said maximum extendable position; and, a depressable button at another end of said locking bar near said handle, said projection being withdrawn into said tube when said button is depressed.

3. The extendable hand grip control arrangement of claim 2, said locking bar extending from a first end of said tube to a second end of said tube and being pivotable within said tube about a pin pivotally connecting a mid-point of said locking bar to said tube, said locking bar being spring-biased such that said projection is normally urged through said opening of said tube.

4. The extendable hand grip control arrangement of claim 1, said control rod extending along an underside of said tube and being pivotally connected to said lever such that said control rod remains substantially parallel to said tube when said lever is depressed, said control rod having an opening to receive a tongue portion of said pivoting arm, said pivoting arm urging said tongue portion normally away from said rod.

5. The extendable hand grip control arrangement of claim 4, said housing comprising a generally rectangular block having a first slot through which said control rod projects and a second slot to receive a finger element therein, said finger element pivoting said pivoting arm towards said control rod such that said tongue portion of said pivoting arm is received by said opening in said control rod.

6. The extendable hand grip control arrangement of claim 5, said finger element projecting from said handle and being received by said second slot of said housing when said tube is in said fully retracted position.

7. The extendable hand grip control arrangement of claim 1, wherein said track is a profiled metal section which captures a base portion of said housing therein, and wherein movement of said housing is restricted to an extendable distance of said cable.

8. The extendable hand grip control arrangement of claim 1, said cable being spring-biased in a covering which braces said housing in a direction away from said handle.

* * * * *